United States Patent [19]

Johansen

[11] Patent Number: 4,844,696

[45] Date of Patent: Jul. 4, 1989

[54] BLADE ANGLE CONTROL DEVICE FOR USE IN AN AXIAL FLOW FAN THE BLADES OF WHICH ARE ADJUSTABLE DURING OPERATION

[75] Inventor: Ulrik Johansen, Vejle, Denmark

[73] Assignee: Novenco A/S, Naested, Denmark

[21] Appl. No.: 179,777

[22] Filed: Apr. 11, 1988

[30] Foreign Application Priority Data

Apr. 10, 1987 [DK] Denmark ..... 1869/87

[51] Int. Cl.[4] ..... F04D 29/36

[52] U.S. Cl. ..... 416/157 R; 416/168 R

[58] Field of Search ..... 416/147, 205, 157 C, 416/245 B, 157 R, 168 R, 209, 159

[56] References Cited

U.S. PATENT DOCUMENTS

| | | | |
|---|---|---|---|
| 1,927,592 | 9/1933 | Lambert | 416/135 X |
| 3,637,323 | 1/1972 | Chilman et al. | 416/157 R X |
| 3,907,460 | 9/1975 | Pedersen et al. | 416/164 X |
| 4,218,188 | 8/1980 | Säterdal | 416/146 A X |
| 4,619,586 | 10/1986 | Carter | 416/157 R |
| 4,650,402 | 3/1987 | Jones et al. | 416/157 R |

FOREIGN PATENT DOCUMENTS

| | | | |
|---|---|---|---|
| 526062 | 2/1954 | Belgium | 416/157 C |
| 88498 | 5/1983 | Japan | 416/157 C |
| 301113 | 11/1954 | Switzerland | 415/130 |
| 987196 | 1/1983 | U.S.S.R. | 416/205 |
| 637238 | 5/1950 | United Kingdom | 415/DIG. 3 |
| 1011419 | 12/1965 | United Kingdom | 416/245 B |
| 1372962 | 11/1974 | United Kingdom | 416/157 C |

*Primary Examiner*—Jr. Powell

*Attorney, Agent, or Firm*—Sughrue, Mion, Zinn, Macpeak & Seas

[57] ABSTRACT

A blade angle control device for an axial flow fan, the blades (7) of which are adjustable between two extreme positions during operation, comprises a control ring (9) coaxial with the hub (1) of the fan impeller and connected, through links (15), with control arms of each blade. In an initial position, where the blades are in one extreme position, the control ring (9) abuts on one face of the hub (1) which is located in a radial plane of the impeller. A pneumatically operated piston device (11,12,14) connected to the control ring (9) and located radially within the ring may shift the ring axially from the initial position towards a position in which the blades are in their other extreme position. A plurality of precompressed springs are located in tubes (18) extending through bores in the hub radially outside the piston device. Each spring surrounds a pin (19) connected to the control ring and biases the ring towards its initial position. The mass of the impeller is concentrated on a short axial length so that the impeller can be secured directly to the shaft (2) of a drive motor. By varying the number springs and possibly their length and precompression the total spring force, preload and spring rate of the control device can be adapted to any need.

8 Claims, 2 Drawing Sheets

Figure 1:
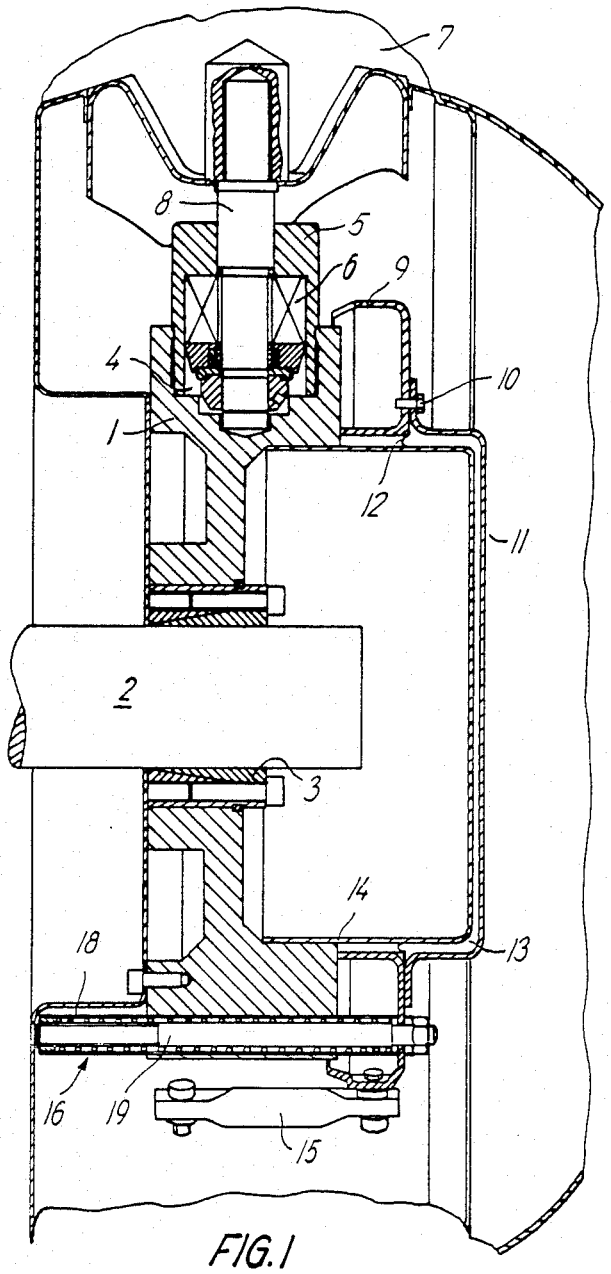

BLADE ANGLE CONTROL DEVICE FOR USE IN AN AXIAL FLOW FAN THE BLADES OF WHICH ARE ADJUSTABLE DURING OPERATION'

This invention relates to a blade angle control device for use in an axial flow fan, the blades of which are adjustable between two extreme positions during operation of the fan. The device comprises a control ring coaxial with the hub of the fan impeller and connected, through links, with control arms of each blade, an actuating device for shifting the control ring axially from an initial position in which the blades are in one extreme position, towards a position in which the blades are in the other extreme position, said actuating device including a pneumatically operated piston device connected with the control ring and arranged internally thereof, and return spring means for exerting a force biasing said control ring towards said initial position.

During operation of the fan it is necessary to control the blade angle, for one thing in order to keep the blades in closed position when the fan is started so as to avoid overloading the fan drive motor and ensure rapid acceleration of the fan to its service speed, and also in order to adapt the output of the fan to the desired output.

From British patent specification no. 1 011 419 there is known a fan having a control device of the kind referred to above, wherein a single return spring and the piston device are arranged coaxially about the axis of the hub in a housing mounted on the hub in extension thereof, which results in a high mounting length of the complete hub.

The present invention provides, for an axial flow fan, a blade angle control device which, when built together with the impeller hub results in such short length thereof that the center of gravity of the impeller is located in or close to a radial plane extendig through the blade centers, so that the impeller may be secured directly to the stub shaft of a standard drive motor.

According to the invention a blade angle control device of the kind initially referred to is characterized in that in the initial position the control ring abuts against one face of the hub which face is located substantially in a radial plane of the impeller, and in that the return spring means includes a plurality of springs mounted in tubes extending through bores in the hub externally of said piston device, each tube surrounding a pin connected to the control ring for transmitting the spring force.

Due to the low axial length of the impeller and the resulting mass concentration the bending forces acting on the shaft of the drive motor as well as the torques prevailing during acceleration and deceleration of the impeller are so small that the impeller can be secured directly to the stub shaft of the drive motor. By providing a plurality of springs for creating the necessary return force the force to be exerted by each spring is reduced, and by varying the number of springs and, if desired, their length and preload the total spring force, preload and spring rate of the control device may be adapted to suit any requirement. With an appropriate number of springs the length of the spring receiving tubes is so short that the mounting length of the impeller is not materially increased by the addition of the control device since, as stated, the tubes extend through bores in the hub. The tubes also function as guides for the control ring so that, without any further measures, the parallel movement of the ring in the axial direction is ensured and the radial position of the ring is maintained.

According to a preferred embodiment of the invention the springs are helical compression springs each of which is mounted in a separate tube around the associated pin between a fixed abutment at the end of the tube oriented towards the control ring, and an abutment connected to the opposite end of the pin and axially displaceable within the tube.

This permits the assembly of the spirngs and tubes at the facatory so that they can be carried in stock as preassembled subunits ready to be mounted in the impeller. A special advantage thereof is that the springs can be removed from the impeller without first disassembling the subunit following which the preloaded spring would expand and become relieved. Thus there is no risk of injury to persons such as known from the removal of preloaded springs which are not located.

By providing each of an evenly distributed number of said spring and pin receiving tubes with a stop member for restricting the axial movement of the pin, a limitation of the opening angle of the blades is obtained in a simple manner, and overload on the drive motor is prevented.

The location of the springs radially outside the piston device ensures an even distribution of the force and permits to design the piston device with a low mass, preferably by manufacturing the cover and hub portion of the piston device and the control ring from pressed sheet material, so that the mass of the impeller is further concentrated around the radial plane through the blade centers.

With the above described design any wear on the control device will be distributed design any wear on the parts, and the return spring arrangement can be replaced without interfering with the hub.

Figure 2:
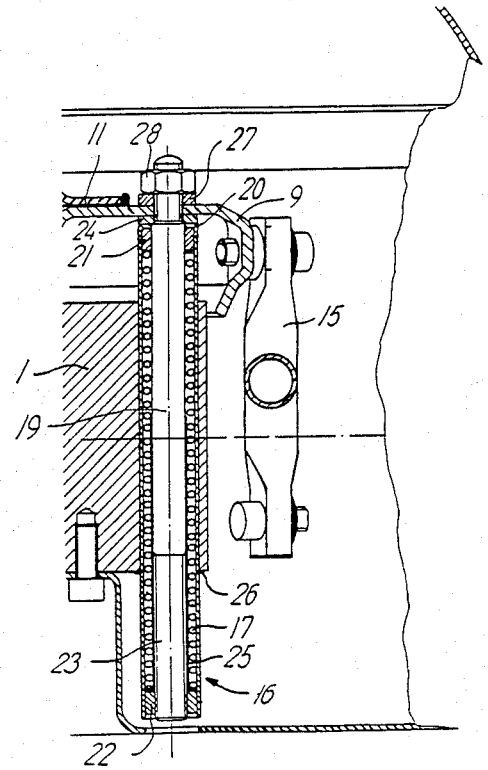
Figure 3:
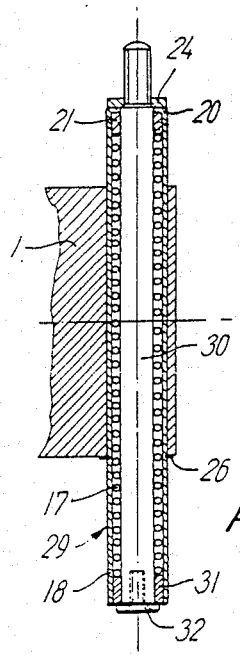

The invention will be described in more detail below with reference to the accompanying drawings in which FIG. 1 is a cross section through a blade angle control device embodying the invention and mounted on a hub constructed as a compact unit, FIG. 2 is a fractional view, on a larger scale, of the device of FIG. 1, and FIG. 3 is a cross section through a modified sub-unit, including a helical compression spring, as mounted in a hub.

In FIG. 1 there is shown a blade angle control device mounted on a fan impeller comprising a compact hub 1. The hub is secured directly to the stub shaft 2 of a drive motor by means of taper sleeves 3. Along its periphery hub 1 is formed with a plurality of threaded bores 4, and a bearing housing 5 in which a thrust bearing 6 servig for journalling a shaft 8 of a blade 7 is retained axially, has been screwed into each bore 4.

A control ring 9 is arranged coaxially with hub 1, and screw means 10 secure ring 9 rigidly to a cover 11 forming one part of a pneumatic piston device operative as actuating device. A rolling diaphragm 12 which in cooperation with cover 11 defines a working space 13 of the piston device, is clamped between ring 9 and cover 11 so as to surround the end of a hub portion 14. The clamping connection is air-tight so that space 13 may be pressurized, e.g. by compressed air, without leakage.

Each blade is associated with a link 15 which at one end is pivotally connected to ring 9 and at its other end is pivoted to a control arm associated with the blade shaft 8 in such a way that an axial displacement of ring 9 is converted to a simultaneous and uniform pivoting of each blade about the blade axis.

When working space 13 is not pressurized the blades are in an extreme position and at the same time cover 11 is located adjacent to hub portion 14, in that the inner most edge of ring 9 oriented towards hub 1 abuts on the hub. When space 13 is pressurized, cover 11 and ring 9 connected thereto move axially away from the hub, and via links 15 blades 7 are pivoted simultaneously. During operation the output of the fan is adapted to the instantaneous need by a continous adjustment of the blade angle in response to the supply of air to space 13 or the venting of air therefrom.

The blades may be pivoted between fully open and fully closed end positions each of which correpsonds to the location of cover 11 adjacent or farthest away from hub portion 14. Generally links 15 are connected to the control arms of the blades such that the blades are in the closed end position corresponding to minimum blade angle when space 13 is not pressurized, because normally the impeller is started with closed blades in order to spare the drive motor. In applications in which a continuous ventilation is important, such as in a hospital surgery, the connection of the links to the control arms may be shifted 180 degrees, so that the blade angle is decreased when compressed air is supplied to space 13. The blades will then open if the supply of compressed air fails and thus the uninterrupted operation of the fan is ensured.

A plurality of angularly equispaced spring units 16 or 29 arranged about the impeller axis bias ring 9 towards hub 1, so that when the pressure in space 13 decreases, the spring units pull the ring towards the hub. Spring units 16 and 29 are arranged in bores adjacent the periphery of the hub and radially outside the piston device, and they also function as guides for ring 9 so that the movement thereof is purely translatory without rotation relative to the hub. This ensures a simultaneous and uniform angular adjustment of all blades.

At least two spring units 16 which are also angularly equispaced, are equipped with adjustable stop means for restricting the axial movement of ring 9.

FIG. 2 shows one of said units 16 as mounted in a bore in the hub. The unit comprises a helical compression spring 17 arranged in a tube 18 around a pin 19. At its end oriented towards ring 9 the tube is formed with an inturned collar 20 which functions as a fixed stop for spring 17. The spring is preloaded between a sleeve 21 abutting against collar 20 and a nut 22 screwed onto the threaded end 23 of pin 19 remote from ring 9. A stop nut 24 is screwed onto the opposite end of pin 19 outside collar 20 in order to retain the spring arrangement within the tube.

A piece of tube 25 which is shorter than tube 18 is located between pin 19 and spring 17 and axially movable with the pin in order to restrict the axial movement of the pin. At its end oriented towards nut 22 tube 25 has an outwardly projecting flange which is urged against the nut by spring 17 so as to retain the tube relative to pin 19. The maximally open position of the blades is adjusted by shifting nut 22 along thread 23.

After tube 18 has been inserted into the bore in the hub, the axial movement of the tube towards ring 9 is limited by a circlip 26 mounted in a circumferential groove in the outer surface of the tube. This ensures a particularly easy mounting and dismounting of the control device.

Pin 19 extends through a hole in ring 9 and is secured to the ring by a nut 27 and locknut 28.

FIG. 3 shows a spring unit 29 which, except for the missing stop member, is similar to unit 16. A pin 30 is without a thread at the end remote from ring 9 and as shown spring 17 is retained by a sleeve 31 abutting on a shoulder formed at the end of pin 30 by a screw 32 the head diameter of which is larger than the diameter of pin 30 and smaller than the inner diameter of tube 18.

When space 13 is pressurized during operation of the fan whereby ring 9 is displaced away from hub 1 each pin 19 or 30 will be pulled out of its tube 18 and spring 17 will be compressed. When subsequently the pressure in space 13 is reduced, the combined spring force will return ring 9 towards the hub.

It is advantageous to assemble the spring units in the factory. First sleeve 21 and spring 17 are inserted into tube 18. Then either pin 30 including sleeve 31 and screw 32 or pin 19 including tube 25 and nut 22, as the case may be, is pushed through tube 18 whereby spring 17 is compressed and consequently preloaded. When the forward end of the pin projects beyond collar 20, nut 24 is screwed onto the end of the pin. Finally circlip 26 is mounted in the groove in the tube surface.

The control device is not limited to being used with a hub of compact type, but can be employed in combination with any type of pneumatically controlled axial flow fan.

I claim:

1. A blade angle control device for use in an axial flow fan comprising; a fan impeller having a hub (1) and blades (7) each of which have a control arm and which are adjustable between two extreme positions during operation, a control ring (9) coaxial with the hub (1) of the fan impeller, links (15) connecting the control ring with a respective control arm of each blade, pneumatically operable piston means (11, 12, 14) connected to the control ring (9) and arranged internally thereof, return spring means, said piston means and return spring means constituting a portion of an actuating device for shifting the control ring axially from an initial position in which the blades are in one extreme position, to a position in which the blades are in the other extreme position, the return spring means exerting a force biasing said control ring toward said initial position, wherein said hub (1) has an exterior face which is located substantially in a radial plane of the fan impeller and through-going bores externally of said piston means, the control ring (9) abutting against said exterior face when it is in the initial position, and said return spring means comprises pins (19, 30) connected to the control ring (9) for transmitting the spring force, a plurality of tubes (18) extending through said bores in the hub and each surrounding one of said pins, and a plurality of springs (17) mounted in said tubes.

2. A control device as claimed in claim 1, wherein each tube (18) has a fixed abutment (20) at an end oriented towards the control ring, each pin (19, 30) has an abutment (22, 31, 32) connected to its end remote from the control ring and is axially displaceable within the associated tube, and the springs comprise helical compression springs (17) each mounted in a separate tube around an associated pin between the fixed abutment and the abutment displaceable with the pin.

3. A control device as claimed in claim 1, further comprising a stop member (22, 25) for limiting the axial movement of the pin (19) provided in each of an evenly distributed number of said tubes (18) with springs (17) and pins.

4. A control device as claimed in claim 3, wherein said stop member (22, 25) comprises a piece of tube (25) arranged between a respective pin and the spring to surround a portion of said pin (19) from said opposite end thereof.

5. A control device as claimed in claim 4, wherein each pin is provided with a threaded portion (23), a nut (22) screwed onto said threaded portion, and said piece of tube (25) includes at one of its ends a protruding flange, the spring urging the flange into abutment against the nut.

6. A control device as claimed in claim 1, wherein each of said tubes (18) with the built-in springs (15, 17) and pins (19, 30) are separately manufactured units.

7. A control device as claimed in claim 1, wherein the piston device includes a cover (11) secured to the control ring (9), a hub portion (14) and a rolling diaphragm (12) clamped airtightly between the ring and the cover and surrounding the end of the hub portion, said cover and said diaphragm defining a working space (13) of the piston device.

8. A control device as claimed in claim 7, wherein the cover (11) and hub portion (14) of the piston device and the control ring (9) are made of pressed sheet material.

* * * * *